US005980202A

United States Patent [19]

Tomita et al.

[11] Patent Number: 5,980,202

[45] Date of Patent: Nov. 9, 1999

[54] GAS TURBINE STATIONARY BLADE

[75] Inventors: Yasuoki Tomita; Kiyoshi Suenaga; Taku Ichiryu, all of Hyogo-ken, Japan

[73] Assignee: Mitsubishi Heavy Industries, Ltd., Tokyo, Japan

[21] Appl. No.: 09/035,587

[22] Filed: Mar. 5, 1998

[51] Int. Cl.[6] ..... F01D 5/18

[52] U.S. Cl. ..... 415/115; 415/116; 415/114; 416/97 A; 416/97 R

[58] Field of Search ..... 415/114, 115, 415/116, 117; 416/97 R, 97 A

[56] References Cited

U.S. PATENT DOCUMENTS 5,253,976 10/1993 Cunha ..... 415/114
5,320,483 6/1994 Cunha et al. ..... 415/114
5,399,065 3/1995 Kudo et al. ..... 415/155
5,634,766 6/1997 Cunha et al. ..... 415/115
5,749,701 5/1998 Clarke et al. ..... 415/115

*Primary Examiner*—Edward K. Look
*Assistant Examiner*—Ninh Nguyen
*Attorney, Agent, or Firm*—John P. White; Cooper & Dunham LLP

[57] ABSTRACT

A gas turbine stationary blade having a cooling medium passage and outer and inner shrouds in a blade section, comprising a hollow portion in the blade section, the hollow portion including a plurality of chambers divided in the chord direction, the cooling medium passage being formed by connecting the divided chambers in series, one of the chambers located in the center with respect to the chord direction being formed as a sealing air passage in order to allow a cooling medium to flow from the outside of the outer shroud to the bore of the inner shroud.

3 Claims, 3 Drawing Sheets

GAS TURBINE STATIONARY BLADE

BACKGROUND OF THE INVENTION

The present invention relates to a gas turbine stationary blade of a steam-cooled type, and more specifically, a gas turbine stationary blade having an inter-stage seal between a bore thereof and a rotor.

In a conventional gas turbine stationary blade, a passage is provided in its hollow and a discharged air from a compressor or extraction gas is run in the passage. By doing this, the blade is cooled so that the blade metal temperature is maintained at a certain allowable value lower than the temperature of a main gas.

The inside space of the blade serves also as a cooling air passage in which an air curtain is formed by inter-stage sealing.

In the steam-cooled gas turbine stationary blade, moreover, steam is circulated in place of air that is used in a conventional blade.

In some gas turbine stationary blades that utilize steam for blade cooling, the used steam is discharged into the main gas without being recovered. Preferably, however, all the steam used for cooling should be recovered.

In order to recover all the used steam, it is necessary, as in the conventional arrangement, to supply inter-stage cooling air to the bore-side seal so as to form a curtain of a low-temperature gas, thereby preventing the main gas from leaking out into the seal.

The trailing edge of the blade is so thin that it is difficult to provide passage means for steam circulation with a given area therein. Also in the steam cooling system, the blade wall may be formed having holes that extends from the inside of the blade into the main gas so that air can be run through the holes.

Thus, a blade section of the steam-cooled gas turbine stationary blade must be provided with steam passages, air passage means for the trailing edge, and air passage means for inter-stage sealing.

While a trailing edge cooling portion of the stationary blade directly opens on the outlet side of the blade, sealing air must be kept at a pressure higher than the pressure on the upstream side of the blade. It is difficult, therefore, to join the passage means for the trailing edge cooling air and the inter-stage sealing air.

In order to integrate the air passage means to secure the necessary cross-sectional area, the thin trailing edge portion of the blade must be provided with a passage that is elongated in the chord direction. Thereupon, the cross-sectional area of the blade that requires air-cooling increases, so that the cooling air must be increased in quantity. Thus, the steam cooling effect is reduced.

BRIEF SUMMARY OF THE INVENTION

The object of the present invention is to provide a gas turbine stationary blade, which has a hollow profile to allow the passage of cooling steam and is effectively furnished with passages for trailing edge cooling air and inter-stage sealing air.

In order to achieve the above object, according to the present invention, there is provided a gas turbine stationary blade having a hollow profile, in which a plurality of chambers are divided in the chord direction, and a cooling medium passage is formed by connecting the divided chambers in series. One of the chambers located in the center with respect to the chord direction, which has a great thickness, is formed as an inter-stage sealing air passage through which air is allowed to flow from the outside of an outer shroud to the bore of an inner shroud.

In the gas turbine stationary blade of the invention described above, the chambers may be further divided into groups connected in series to form a plurality of cooling steam passages.

In the stationary blade of the invention, moreover, the inter-stage sealing air passage is covered by a member having one end connected directly to the shrouds and the other end defining the cooling medium passage. A blade section is formed extending outward from the shrouds, and its passage-side face opens to the outside of the shrouds.

According to the gas turbine stationary blade of the invention arranged in this manner, the inter-stage sealing air passage is provided in a thick portion of the blade, so that its length in the chord direction can be shortened. Thus, the cooling air passage can be formed with a minimum area for other regions than the object of cooling.

According to the stationary blade of the invention, furthermore, the inter-stage cooling air passage and air passage means for the trailing edge can be separated by forming the cooling air passage in the aforesaid manner. Accordingly, a passage area can be selected such that each air passage can be adjusted to a suitable air pressure, or the quantity of air supply can be regulated by means of orifices formed in each passage.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Figure 2:
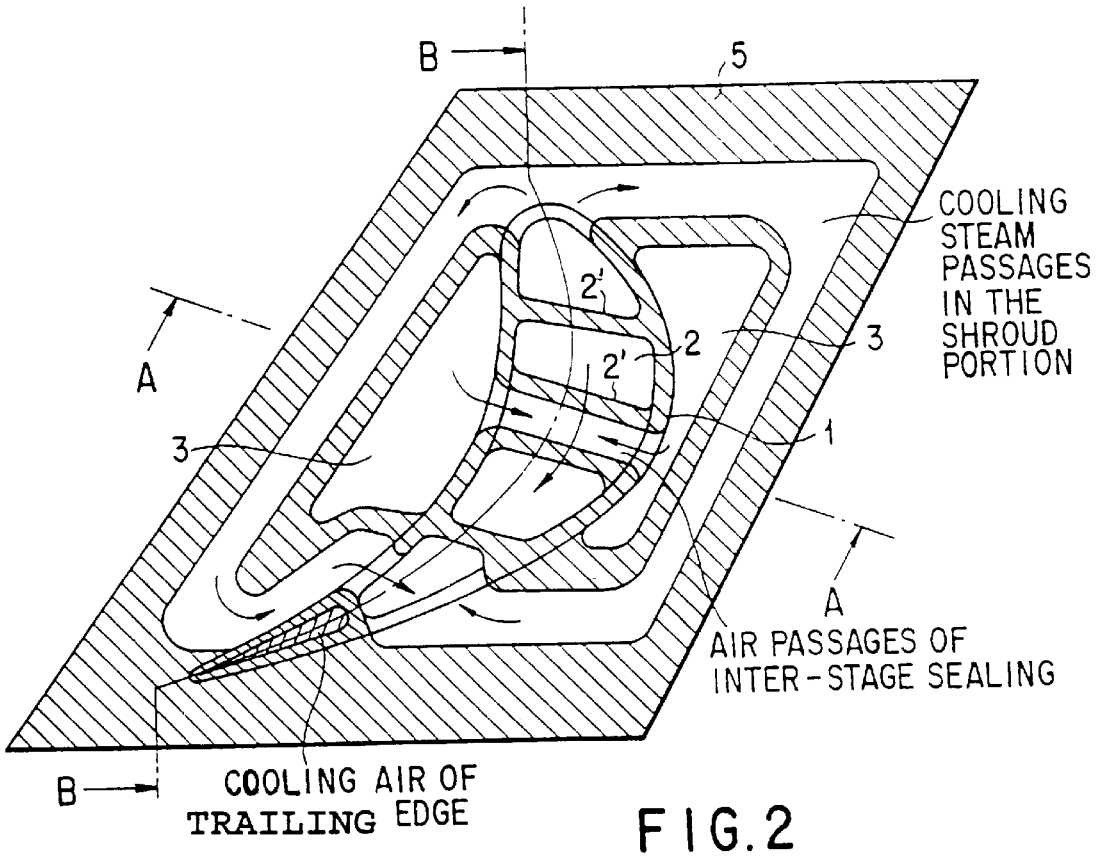
FIG. 2 is a plan sectional view of the stationary blade taken along line C—C of FIG. 1.
Figure 3:
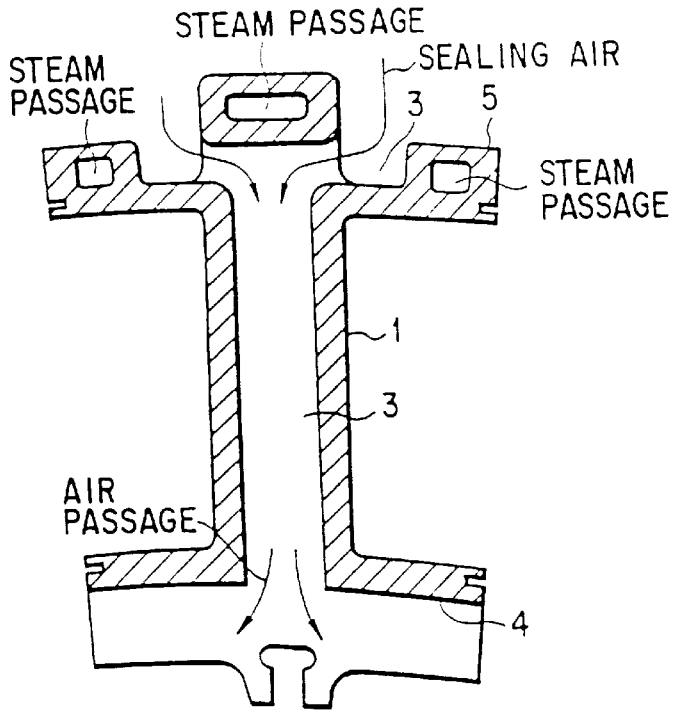
FIG. 3 is a vertical sectional view of the stationary blade taken along line A—A of FIG. 2.

A gas turbine stationary blade according to an embodiment of the present invention will now be described in detail with reference to the accompanying drawings of FIGS. 1 to 3. In this stationary blade, a blade section 1 has a hollow profile, and its inside space is divided into a plurality of chambers 2 by a diaphragm 2'. The chambers 2 are connected in series with one another to form a serpentine cooling steam passage, and cooling steam is circulated through the steam passage.

In the central portion of the chord of the stationary blade that has the greatest thickness, inter-stage sealing air passages 3 are arranged between the upward and downward steam passages.

One end (lower end) of each sealing air passage 3 opens directly in a shroud face 4, while the other end (upper end) is covered by two steam passages 6 and 7 that extend on either side of the air passage 3.

On the upper end side, therefore, the blade section 1 extends on the upper surface of a shroud 5 and opens in a side face 8.

Figure 1:
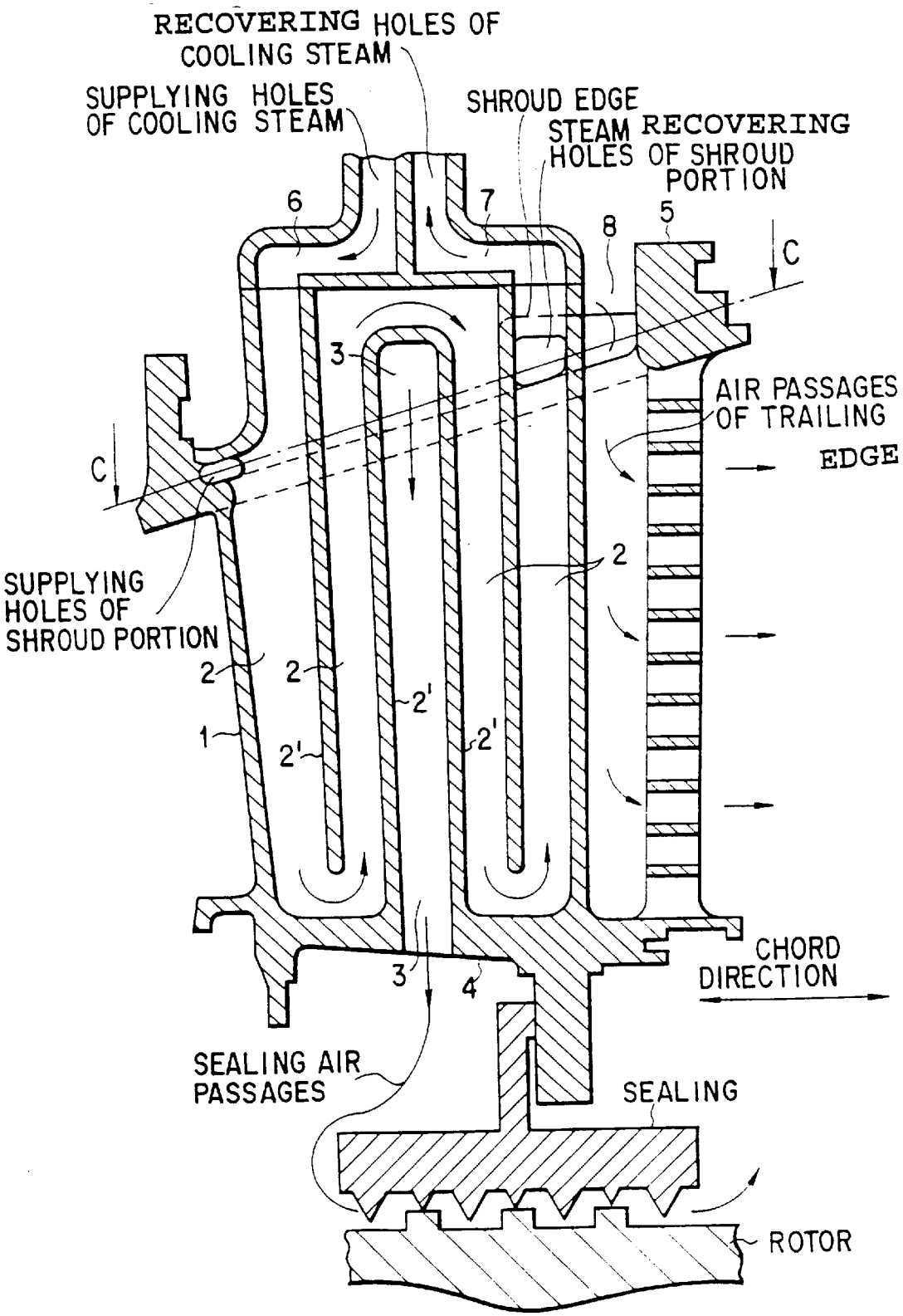
FIG. 1 is a vertical sectional view of a gas turbine stationary blade according to an embodiment of the present invention taken along line B—B of FIG. 2.

In FIG. 1, the arrows indicate flows of steam and air in the cooling steam passages 6 and 7 and the sealing air passages 3.

As shown in FIG. 1, moreover, air passages for trailing edge cooling are formed in the trailing edge of the stationary blade. The trailing edge is cooled by the air that flows in the way indicated by the arrows.

According to the embodiment described herein, the chambers 2, which are separated in the chord direction, are connected in series with one another to form the one cooling steam passage. Alternatively, however, chambers 2 may be further divided into groups that are connected in series to form a plurality of cooling steam passages.

In the gas turbine stationary blade according to the present invention, as described above, there may be provided the cooling steam passages, inter-stage sealing air passages, and trailing edge air passages in the trailing edge that is too thin to be readily formed having passages for steam circulation therein.

Figure 1A:
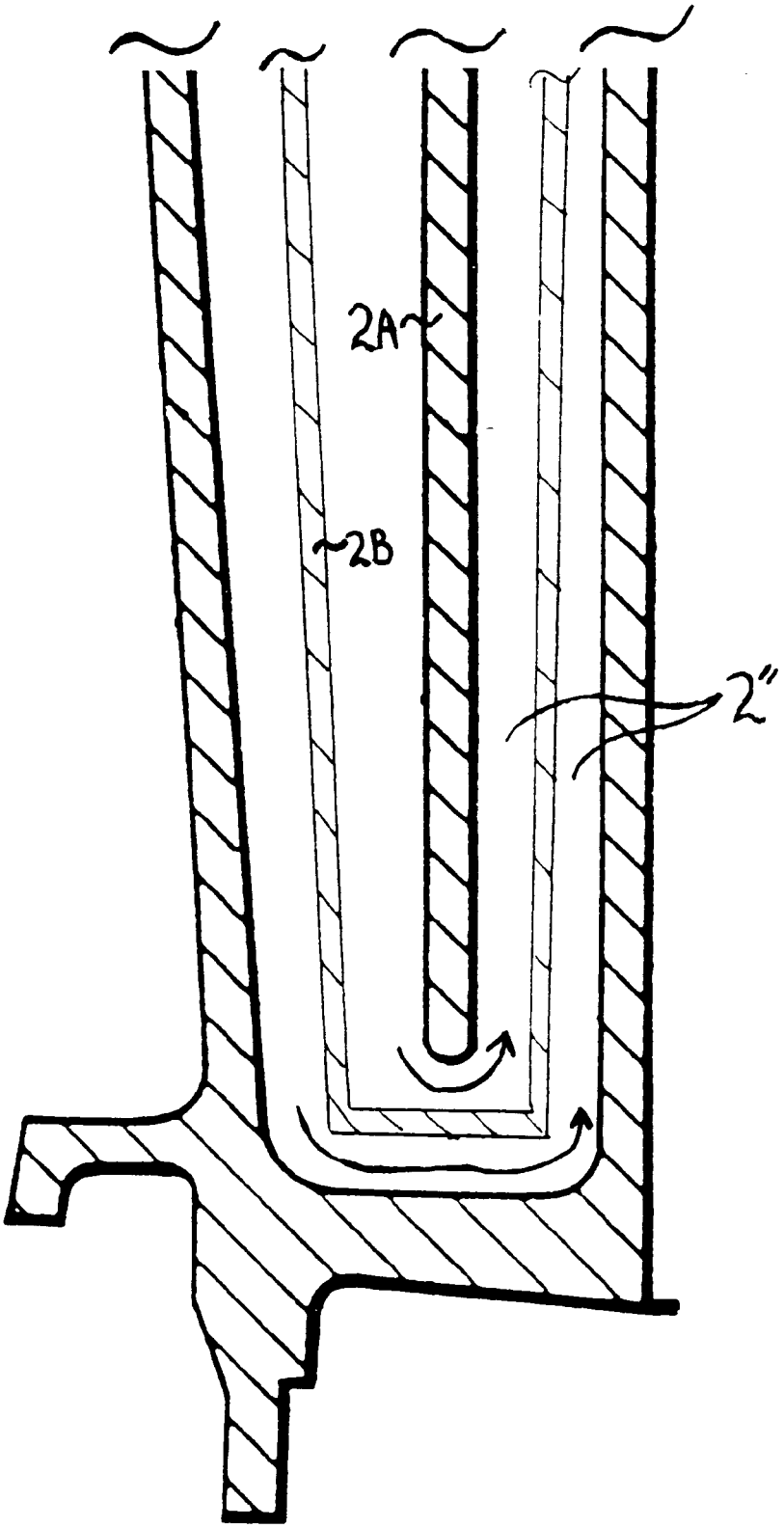
FIG. 1A is a vertical sectional view of a portion of the serpentine cooling steam passage of a gas turbine stationary blade according to an embodiment of the present invention taken along line B—B of FIG. 2.

Thus, according to the gas turbine stationary blade of the invention, fluids for individual purposes can be supplied under suitable pressures to the passages formed therein, so that the control of the fluid supply is easy. In another embodiment of the invention, as shown in FIG. 1A, the chambers further divided into groups of chambers 2" and diaphragms 2A and 2B connected in series to for a plurality of cooling steam passages.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

We claim:

1. A gas turbine stationary blade having a cooling medium passage and outer and inner shrouds in a blade section, comprising:

a hollow portion in the blade section, the hollow portion including a plurality of chambers divided in the chord direction, one of the chambers located in the center with respect to the chord direction being formed as an inter-stage sealing air passage in order to allow a cooling medium to flow from the outside of the outer shroud to the bore of the inner shroud, wherein the inter-stage sealing air passage is covered by a member having one end connected directed to the shrouds and the other end defining the cooling medium passage.

2. A gas turbine stationary blade according to claim 1, wherein said chambers are further divided into groups connected in series to form a plurality of cooling steam passages.

3. A gas turbine stationary blade according to claim 1, wherein said inter-stage sealing air passage is situated in the center with respect to the chord direction.

* * * * *